US006045419A

United States Patent [19]

Mineno et al.

[11] Patent Number: 6,045,419

[45] Date of Patent: Apr. 4, 2000

[54] OUTBOARD MOTOR

[75] Inventors: Kazuo Mineno; Keisuke Daikoku, both of Hamamatsu, Japan

[73] Assignee: Suzuki Kabushiki Kaisha, Hamamatsu, Japan

[21] Appl. No.: 09/012,486

[22] Filed: Jan. 23, 1998

[30] Foreign Application Priority Data

Jan. 31, 1997 [JP] Japan ..... 9-019465

[51] Int. Cl.[7] ..... B63H 1/14; B63H 20/32

[52] U.S. Cl. ..... 440/49; 440/76

[58] Field of Search ..... 440/49, 76, 900, 440/88; 248/640; 123/196 R

[56] References Cited

U.S. PATENT DOCUMENTS

| | | | |
|---|---|---|---|
| 3,195,521 | 7/1965 | Larsen | 123/41.47 |
| 5,309,877 | 5/1994 | Shigedomi et al. | 123/19.5 |
| 5,514,015 | 5/1996 | Okazawa et al. | 440/88 |
| 5,830,021 | 11/1998 | Takahashi et al. | 440/88 |
| 5,876,188 | 3/1999 | Okamoto | 417/364 |

FOREIGN PATENT DOCUMENTS

| | | | |
|---|---|---|---|
| 404345592A | 12/1992 | Japan | 21/26 |

*Primary Examiner*—S. Joseph Morano
*Assistant Examiner*—Patrick Craig Muldoon
*Attorney, Agent, or Firm*—Finnegan, Henderson, Farabow, Garrett & Dunner, L.L.P.

[57] ABSTRACT

An outboard motor to be mounted to a hull comprises an engine holder connected to the hull, an engine mounted on the engine holder in a perpendicular fashion in which a crank shaft of the engine extends vertically, an oil pan mounted to a lower portion of the engine holder, and an oil pump for supplying an oil stored in the oil pan to the engine, in which the engine including a crank case, a cylinder block and a cylinder head, which are all secured to the engine holder by fastening bolts for improving the rigidity of a mounted engine and that of an assembled outboard motor and simplifying the structure thereof.

2 Claims, 2 Drawing Sheets

OUTBOARD MOTOR

BACKGROUND OF THE INVENTION

The present invention relates to an outboard motor having an improved structure for assembling the same.

The major portion of an outboard motor is arranged in such a manner that an engine is mounted on an upper portion of an engine holder formed so as to provide substantially a horizontal plate-like shape which is connected to a hull, to which an outboard motor is mounted through a crank bracket. Generally, the engine is mounted on the engine holder in a standing fashion so that the crank shaft has a vertically attitude. In a case of a four-stroke-cycle engine, an oil pan is disposed below the engine holder to cause oil accumulated in the oil pan to be supplied to the inside portion of the engine to lubricate the inside of the engine.

The engine is composed by combining a crank case, a cylinder block, a cylinder head and the like. Hitherto, only the crank case and the cylinder block are secured to the engine holder, while the cylinder head is floated from the engine holder. Moreover, the engine and the oil pan are secured to the engine holder with individual fixing bolts.

However, in the above-mentioned layout, since only the crank case and the cylinder block of the engine are secured to the engine holder, the engine and the engine holder are connected to each other in a small area. Thus, there is apprehension that the rigidity of the mounted engine is insufficient in a case of a large size engine or the like.

Furthermore, since the cylinder head floats from the engine holder, it is impossible to directly return an oil in the cylinder head to the oil pan, it is necessary to adopt a structure that a specific oil returning passage is formed in the cylinder block to temporarily introduce oil in the cylinder head to the cylinder block and then return the oil to the oil pan. When the above-mentioned oil returning passage is formed, the structure of the cylinder block becomes too complicated to be easily manufactured and to reduce the weight.

Furthermore, since the engine and the oil pan are secured to the engine holder through individual fixing bolts, the rigidity of the overall assembled body of the outboard motor is unsatisfactory and reduction in the number of elements and assembling steps cannot be realized.

SUMMARY OF THE INVENTION

A primary object of the present invention is to substantially eliminate defect or drawbacks encountered in the prior art and to provide an outboard motor and an assembling structure thereof capable of improving the rigidity of a mounted engine and simplifying the structure of a cylinder block to easily manufacture the same.

Another object of the present invention is to provide an outboard motor and an assembling structure thereof capable of improving the rigidity of the assembled outboard motor and reducing the number of fixing bolts to reduce the number of elements and assembling steps.

A further object of the present invention is to provide an outboard motor and an assembling structure thereof capable of protecting an oil pump from being damaged when the engine is solely removed from the outboard motor to elongate the life of the oil pump.

These and other objects can be achieved according to the present invention by providing an outboard motor to be mounted to a hull comprising:

an engine holder connected to the hull;

an engine mounted to an upper portion of the engine holder in substantially a vertical fashion in which a crank shaft of the engine extends perpendiculrly;

an oil pan mounted to a lower portion of the engine holder; and an oil pump for supplying an oil stored in the oil pan to the engine, the engine including a crank case, a cylinder block and a cylinder head, which are all secured to the engine holder by fastening means.

In the preferred embodiment, the fastening means comprises a plurality of fastening bolts including a bolt for fastening the engine to the engine holder, which penetrates the oil pan and the engine holder from the lower side thereof and is secured to a lower surface of the engine to commonly secure the oil pan and the engine holder to the engine, and further including a bolt for fastening the crank case to the engine holder and a bolt for fastening the cylinder head to the engine holder.

The oil pump to be driven by the engine is arranged in the oil pan on the lower surface side of the engine holder.

According to the outboard motor and the structure for assembling the same of the present invention, the overall lower surface of the engine can be brought into contact with the engine holder. Therefore, the mutual connection area between the engine and the engine holder can be enlarged. Thus, the rigidity of the mounted engine can significantly be improved. Furthermore, since the cylinder head is in contact with the engine holder, a structure can be employed in which oil supplied to the cylinder head is directly returned to the oil pan without passing through the cylinder block. Thus, the structure of the cylinder block can be simplified and, therefore, the cylinder block can easily be manufactured.

Still furthermore, according to the structure of the present invention, the engine, the engine holder and the oil pan are integrally fastened by the fixing bolts, so that the engine holder is used as an important member for improving the overall rigidity of the outboard motor without merely serving as a simple joint. Therefore, the overall rigidity of the assembled outboard motor can be improved. Since the engine and the oil pan are secured to the engine holder with the same fixing bolts, the number of the fixing bolts can be reduced while the rigidity of the assembled outboard motor is maintained. Thus, the outboard motor assembling steps can be also reduced.

According further to the structure of the outboard motor of the present invention, the oil pump remains adjacent to the engine holder when the engine has solely removed from the outboard motor. Therefore, damage of the oil pump can be prevented. The oil pump is not exposed to the outside after the engine has been removed because the oil pump is retained in the oil pun, so that drying of the oil pump and introduction of foreign matter into the oil pump can be prevented. As a result, the life of the oil pump can be elongated.

The nature and other characteristic features and advantages of the present invention will be made clear from the following description of the preferred embodiments made with reference to the accompanying drawings.

DESCRIPTION OF THE PREFERRED EMBODIMENT

Figure 1:
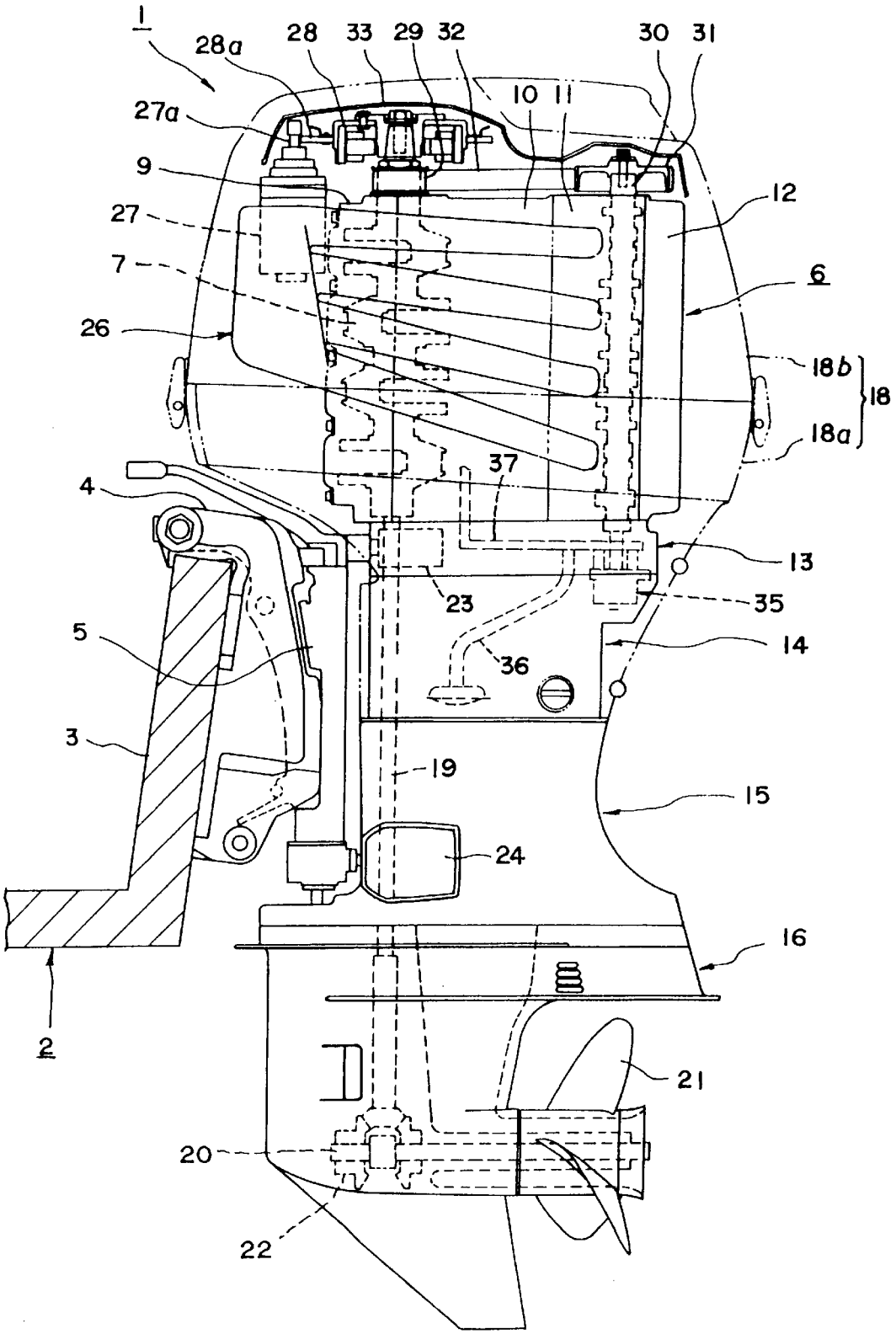
FIG. 1 is a left side view showing an embodiment of an outboard motor to which an improved structure for assembling the outboard motor according to the present invention is applied.

An embodiment of the present invention will be described hereunder with reference to the accompanying drawings.

An outboard motor 1 is mounted on a transom 3 of a hull 2 through a crank bracket 4 to be turnable horizontally about a swivel shaft 5 vertically disposed in the rear portion of the crank bracket 4.

Figure 2:
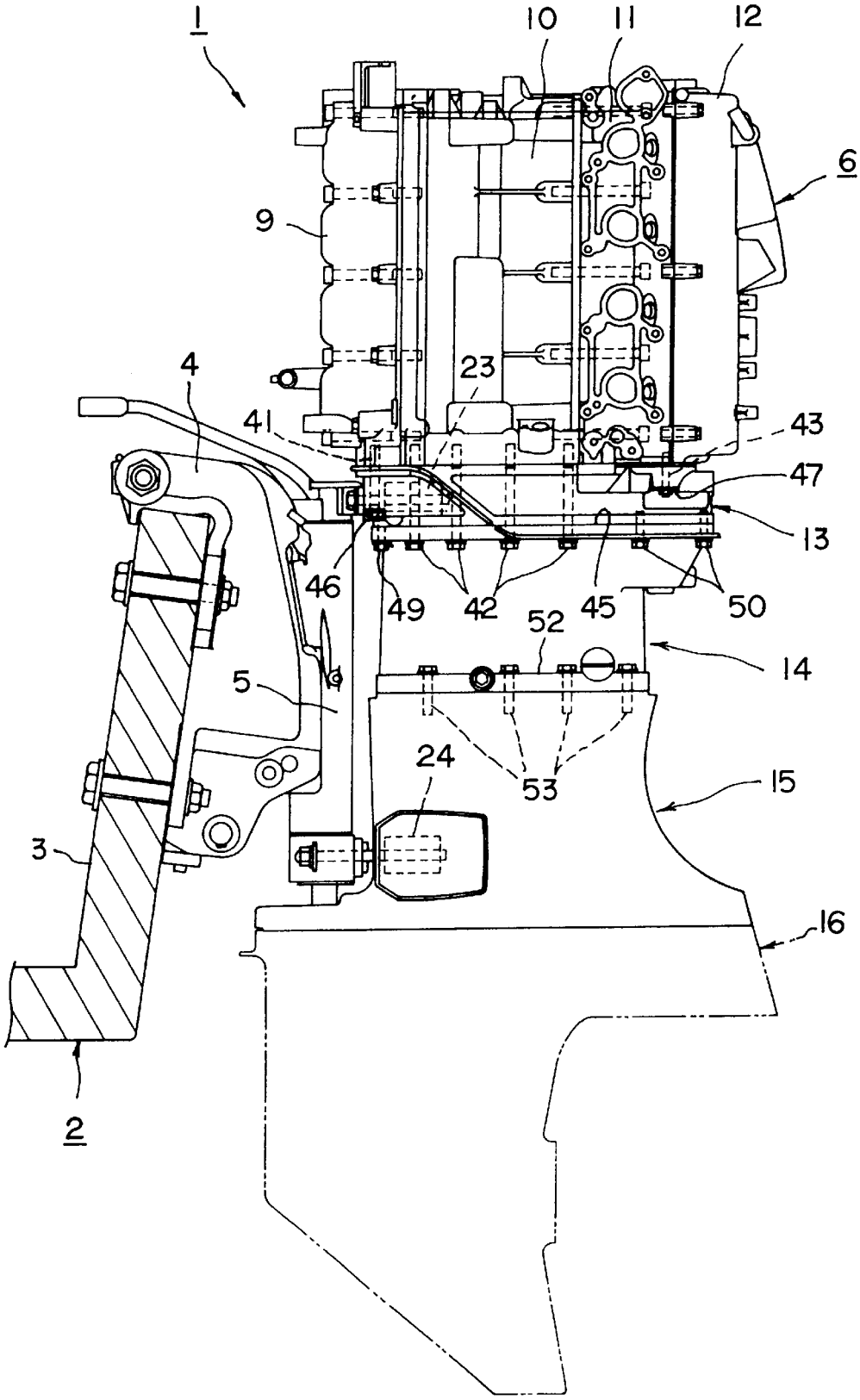
FIG. 2 is a left side view showing an engine, an engine holder, an oil pan and the like according to the embodiment of the present invention.

An engine 6 mounted in the uppermost portion of the outboard motor 1 is, for example, an in-line, four-cylinder, water-cooled and four-stroke-cycle gasoline engine, the engine 6 being mounted in standing fashion with a crank shaft 7 being positioned vertically. As shown in FIG. 2, the engine 6 is composed of a crank case 9, a cylinder block 10, a cylinder head 11 and a head cover 12 which are disposed in series in the longitudinal direction of the outboard motor 1.

An oil pan 14 is secured to the lower portion of the engine 6 through an engine holder 13 formed into a substantially horizontal plate-like shape. A drive-shaft housing 15 is secured to the lower portion of the oil pan 14, and a gear housing 16 is secured to the lower portion of the drive-shaft housing 15. The engine 6, the engine holder 13 and the oil pan 14 are covered with an engine cover 18 which can be sectioned vertically. The engine cover 18 has a lower cover section 18*a* , secured so as to entirely cover the engine holder 13 and the oil pan 14, and an upper cover section 18*b* detachably attached above the lower cover section 18*a*. A maintenance working of the engine 6 or the like is performed by removing the upper cover section 18*b*.

A drive shaft 19 extending downwards is integrally connected to the lower end of the crank shaft 7 of the engine 6 to be rotatable. The drive shaft 19 is allowed to penetrate the engine holder 13, the oil pan 14 and the drive-shaft housing 15 so as to extend the inside portion of the gear housing 16.

On the other hand, a propeller shaft 20 extending longitudinally is supported to be rotatable in the gear housing 16, and a propeller 21 is integrally connected to the rear end of the propeller shaft 20 to be also rotatable. A bevel gear mechanism 22 disposed at the intersection between the drive shaft 19 and the propeller shaft 20 transmits the rotation of the drive shaft 19 to the propeller shaft 20 so as to rotate the propeller 21.

Further, a pair of right and left mounting portions 23 and 24 are formed to the front edge portions of the engine holder 13 and the drive-shaft housing 15 in a vertical alignement. The vertical mounting portions 23 and 24 are pivotally supported at the upper and lower ends of the swivel shaft 5. Therefore, the engine holder 13 and the drive-shaft housing 15 are connected to the hull 2 through the mounting portions 23 and 24.

An air intake unit 26 is mounted to the left side surface, as viewed, of the engine 6. A starter motor 27 for starting the engine 6 is disposed on the front surface of the engine 6. The upper end of the crank shaft 7 projects upwards over the upper surface of the engine 6. A flywheel 28 is integrally disposed at the upper end of the crank shaft 7 to be rotatable, while a drive pulley 29 is disposed below the flywheel 28.

On the other hand, a camshaft 30 is pivotally disposed in the cylinder head 11 to be in parallel to the crank shaft 7. An upper end of the camshaft 30 projects over the upper surface of the engine 6. A driven pulley 31 is integrally attached to the projecting portion to be rotatable.

A timing belt 32 is arranged between the drive pulley 29 of the crank shaft 7 and the driven pulley 31 of the camshaft 30. The timing belt 32 transmits rotations of the crank shaft 7 to the camshaft 30 so that a moving valve mechanism, not shown, accommodated in the cylinder head 11 is operated.

A flange-like ring gear 28*a* is disposed around the flywheel 28 so that a pinion gear 27*a* of the starter motor 27 projects upwards to be engaged with the ring gear 28*a* when the starter motor 27 has been rotated. As a result, the crank shaft 7 is rotated so that the engine 6 is started.

A cover 33 made of synthetic resin or the like covers the starter motor 27, the flywheel 28, the drive pulley 29, the driven pulley 31, the timing belt 32 and the like from an upper sides thereof so that water drops are blocked by the cover 33 to ensure the water-proof structure.

An oil pump 35 is disposed below the engine 6. The oil pump 35 is disposed on the lower surface of the engine holder 13 at a position within the oil pan 14 in which the oil is stored. Thus, the camshaft 30 of the engine 6 operates the oil pump 35.

An oil strainer 36 extending to the bottom of the oil pan 14 is disposed on the lower surface of the engine holder 13. Moreover, an oil passage 37 is formed in the engine holder 13 from the oil strainer 36 to the engine 6 via the oil pump 35.

When the engine 6 has been started, the camshaft 30 is rotated and thus the oil pump 35 is operated. Accordingly, the oil accumulated in the oil pan 14 is filtered by the oil strainer 36 and then sucked by the oil pump 35. The oil discharged from the oil pump 35 is then allowed to pass through the oil passage 37 to reach the inside portion of the engine 6 so as to lubricate the inside portion of the engine 6. The oil, which has lubricated the inside portion of the engine 6, then flows downwards in the engine 6 and returned to the oil pan 14.

The structure for assembling the outboard motor 1 is, as shown in FIG. 2, arranged in such a way that all of the crank case 9, the cylinder block 10 and the cylinder head 11 forming the engine 6 are secured to the engine holder 13 by fixing bolts 41, 42 and 43.

The eight fixing bolts 42 for securing the right and left portions of the cylinder block 10 to the engine holder 13 are, from lower positions, inserted through the upper flange 45 formed in the upper portion of the oil pan 14 so as to project rightward and leftward and then allowed to penetrate the engine holder 13, after which the eight fixing bolts 42 are fixed to the lower surface of the cylinder block 10. That is, the eight fixing bolts 42 fix both the engine holder 13 and the oil pan 14 to the cylinder block 10.

The two right and left fixing bolts 41 for securing the crank case 9 to the engine holder 13 and the two right and left fixing bolts 43 for securing the cylinder block 10 to the engine holder 13 are inserted from lower positions of fixing members 46 and 47 integrally formed with two longitudinal ends of the engine holder 13, and then fixed to the lower surface of the cylinder head 11.

Two right and left short fixing bolts 49 penetrating the frontmost portion of the upper flange 45 of the oil pan 14 from lower positions of the upper flange 45 and four right and left short fixing bolt 50 penetrating the rear portion of the upper flange 45 from lower positions are fixed to the front and rear portions of the lower surface of the engine holder 13. Thus, the clamping force between the oil pan 14 and the engine holder 13 is strengthened.

On the other hand, a lower flange 52 extending horizontally is formed integrally with the lower portion of the oil pan 14 so as to project rightward and leftward. Eight right and left fixing bolts 53 inserted from upper position of the lower flange 52 are fixed to the drive-shaft housing 15.

As described above, the outboard motor 1 is assembled. The above-mentioned assembling structure is arranged such that all of the crank case 9, the cylinder block 10 and the cylinder head 11 of the engine 6 are secured to the engine holder 13 by the fixing bolts 41, 42 and 43. Therefore, the overall lower surface of the engine 6 is brought into contact with the upper surface of the engine holder 13. Since the connection area is enlarged as described above, the rigidity of the mounted engine 6 can significantly be improved.

Since the cylinder head 11 is joined to the engine holder 13, a structure can be employed in which oil supplied to the cylinder head 11 is returned to the oil pan 14 without passing through the cylinder block 10. Therefore, the necessity of forming the specific oil returning passage in the cylinder block 10 can be eliminated. As a result, the structure of the cylinder block 10 can be simplified and thus the cylinder block 10 can easily be manufactured.

Since both engine holder 13 and the oil pan 14 are fixed to the cylinder block 10 by the fixing bolts 42, the cylinder block 10, the engine holder 13 and the oil pan 14 are integrally fastened by the clamping force of the fixing bolts 42. Thus, the engine holder 13 can be used as an important member for improving the overall rigidity of the outboard engine 1 without adopting a structure that the engine holder 13 serves as a simple joint. As a result, the rigidity of the assembled outboard motor 1 can be significantly improved.

Furthermore, the engine holder 13 is a member arranged to be connected to the hull 2 through the mounting portion 23 and the crank bracket 4, so that the engine 6, the oil pan 14 and the ensuing members are strongly secured to the engine holder 13. Therefore, the rigidity of the outboard motor 1 can be maintained when the hull 2 is steered or rapid deceleration of the same is performed.

The fixing structure, in which the cylinder block 10, the engine holder 13 and the oil pan 14 are together fixed by the fixing bolts 42, is able to reduce the number of fixing bolts while the rigidity of the assembled outboard motor 1 has been maintained. Thus, the number of elements of the outboard motor 1 and the assembling steps thereof can be reduced.

Still furthermore, since the outboard motor 1 according to this embodiment has the structure that the oil pump 35 is disposed adjacent to the lower surface of the engine holder 13 at a position within the oil pan 14, the oil pump 35 remains adjacent to the engine holder 13 when the engine 6 is solely removed from the outboard motor 1. Therefore, the oil pump 35 is prevented from projecting over the lower surface of the engine 6 removed from the outboard engine 1. Thus, a problem of a collision of the oil pump 35 with a working bench or the like and a damage caused thereby can be prevented. The oil pump 35 is not exposed to the outside even after the engine 6 has been removed and the same is retained in the oil pan 14, so that the oil pan 14 is not dried and introduction of foreign matter can be prevented. As a result, the life of the oil pump 35 can be elongated.

Although the engine 6 of the outboard motor 1 is the in-line, four-cylinder and four-stroke-cycle engine, the assembling structure according to the present invention may be applied to an outboard motor having, for example, V-type engine or a two-stroke-cycle engine. In the case of the two-stroke-cycle engine, a drive shaft housing is, in place of the oil pan, secured to the lower surface of the engine holder.

It is to be noted that the present invention is not limited to the described structure and the other changes and modifications may be made without departing from the scopes of the appended claims.

What is claimed is:

1. An outboard motor to be mounted to a hull comprising:

an engine holder connected to the hull;

an engine mounted to an upper portion of the engine holder in substantially a vertical fashion in which a crank shaft of the engine extends perpendicularly;

an oil pan mounted to a lower portion of the engine holder; and an oil pump for supplying an oil stored in the oil pan to the engine, said engine including a crank case, a cylinder block and a cylinder head, each of which is secured to the engine holder by fastening means comprising a plurality of fastening bolts, at least one of said bolts fastening the engine to the engine holder, said at least one bolt penetrating the oil pan and the engine holder from the lower side thereof and being secured to a lower surface of the engine to commonly secure the oil pan and the engine holder to the engine, said oil pump being mounted to the lower surface side of the engine holder and arranged in the oil pan on the lower surface side of the engine holder so that the engine is removable from the upper portion of the engine holder without moving the oil pump.

2. An outboard motor according to claim 1, wherein said fastening bolts further include a bolt for fastening the crank case to the engine holder and a bolt for fastening the cylinder head to the engine holder.

* * * * *